US009554624B2

(12) United States Patent
Cross

(10) Patent No.: US 9,554,624 B2
(45) Date of Patent: Jan. 31, 2017

(54) FOOTWEAR SOLES WITH AUXETIC MATERIAL

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/643,145

(22) Filed: Mar. 10, 2015

(65) Prior Publication Data

US 2015/0230548 A1 Aug. 20, 2015

Related U.S. Application Data

(63) Continuation-in-part of application No. 14/030,002, filed on Sep. 18, 2013.

(51) Int. Cl.

| | |
|---|---|
| ***A43B 13/18*** | (2006.01) |
| ***A43B 5/00*** | (2006.01) |
| ***A43B 13/22*** | (2006.01) |
| ***A43B 13/02*** | (2006.01) |

(52) U.S. Cl.

CPC ..... *A43B 13/187* (2013.01); *A43B 5/00* (2013.01); *A43B 13/02* (2013.01); *A43B 13/22* (2013.01)

(58) Field of Classification Search

CPC ..... A43B 3/16; A43B 1/0009; A43B 5/00; A43B 13/12; A43B 13/125; A43B 13/22; A43B 13/181; A43B 13/02; A43B 13/187; A43B 13/188; A43C 15/02; A43C 15/00; A43C 15/065

USPC ..... 36/25 R, 62, 59 R, 159, 160, 97, 1; 428/136

See application file for complete search history.

(56) References Cited

U.S. PATENT DOCUMENTS

| | | | | |
|---|---|---|---|---|
| 503,062 | A | 8/1893 | Norwood | |
| 1,733,733 | A | 10/1929 | Hess | |
| 2,251,468 | A * | 8/1941 | Smith | A43B 13/22 36/32 R |
| 2,432,533 | A | 12/1947 | Margolin | |
| 2,580,840 | A | 1/1952 | Rogndal | |
| 2,800,423 | A * | 7/1957 | De Swart | B29B 15/08 156/253 |
| 2,963,722 | A | 12/1960 | Stix | |
| 3,626,532 | A | 12/1971 | Smith | |
| 3,745,600 | A | 7/1973 | Rubico et al. | |
| 3,757,436 | A | 9/1973 | Winkler et al. | |

(Continued)

FOREIGN PATENT DOCUMENTS

| | | |
|---|---|---|
| CN | 2870531 Y | 2/2007 |
| CN | 101677651 A | 3/2010 |

(Continued)

OTHER PUBLICATIONS

International Search Report and Written Opinion mailed Nov. 17, 2015 in PCT/US2015/040523.

(Continued)

*Primary Examiner* — Clinton T Ostrup
*Assistant Examiner* — Bao-Thieu L Nguyen
(74) *Attorney, Agent, or Firm* — Quinn Law Group, PLLC

(57) ABSTRACT

An article of footwear has an auxetic sole structure formed from members surrounding apertures. The members may have a trapezoidal geometry. Adjoining members are hingedly connected, so that they can rotate with respect to each other in the plane of the sole structure. The rotation allows the auxetic sole structure to expand when tension is applied.

16 Claims, 9 Drawing Sheets

(56) References Cited

U.S. PATENT DOCUMENTS 4,050,108 A 9/1977 Londner
4,272,850 A * 6/1981 Rule ..... A41D 13/065 2/24
4,340,626 A 7/1982 Rudy
4,484,398 A 11/1984 Goodwin et al.
4,668,557 A * 5/1987 Lakes ..... B29C 44/357 264/321
4,756,098 A 7/1988 Boggia
4,858,340 A 8/1989 Pasternak
4,899,412 A 2/1990 Ganon
4,967,492 A 11/1990 Rosen
4,999,931 A 3/1991 Vermeulen
5,060,402 A 10/1991 Rosen
5,188,874 A * 2/1993 Kauffman ..... B29B 15/08 156/163
D339,459 S 9/1993 Yoshikawa et al.
D344,170 S 2/1994 Acoff
5,353,526 A * 10/1994 Foley ..... A43B 1/0009 36/35 R
5,469,639 A 11/1995 Sessa
5,718,064 A 2/1998 Pyle
5,813,146 A 9/1998 Gutkowski et al.
5,918,338 A 7/1999 Wong
D420,786 S 2/2000 Ramer et al.
6,151,804 A 11/2000 Hieblinger
6,178,662 B1 1/2001 Legatzke
6,226,896 B1 5/2001 Friton
6,357,146 B1 3/2002 Wordsworth et al.
6,412,593 B1 7/2002 Jones
6,487,795 B1 12/2002 Ellis, III
6,564,476 B1 5/2003 Hernandez
D487,614 S 3/2004 Le et al.
D488,916 S 4/2004 McClaskie et al.
6,862,820 B2 3/2005 Farys et al.
7,132,032 B2 11/2006 Tawney et al.
7,160,621 B2 * 1/2007 Chaudhari ..... B60R 19/18 293/120
7,252,870 B2 * 8/2007 Anderson ..... B31F 1/07 162/111
7,254,906 B2 8/2007 Morris et al.
7,310,894 B1 12/2007 Schwarzman et al.
D571,543 S 6/2008 Sungadi et al.
7,455,567 B2 11/2008 Bentham et al.
7,487,602 B2 2/2009 Berger et al.
7,546,698 B2 6/2009 Meschter
7,574,818 B2 8/2009 Meschter
D614,382 S 4/2010 Grenet et al.
7,770,307 B2 8/2010 Meschter
7,814,852 B2 10/2010 Meschter
7,827,703 B2 11/2010 Geer et al.
7,870,681 B2 1/2011 Meschter
7,870,682 B2 1/2011 Meschter et al.
8,002,879 B2 * 8/2011 Hook ..... B01D 39/08 210/483
8,084,117 B2 * 12/2011 Lalvani ..... B32B 3/266 428/135
D653,844 S 2/2012 Smith et al.
8,122,616 B2 2/2012 Meschter et al.
8,132,340 B2 3/2012 Meschter
8,186,078 B2 5/2012 Avar et al.
8,196,316 B2 6/2012 Cook et al.
8,220,072 B2 7/2012 Dodd
8,225,530 B2 7/2012 Sokolowski et al.
8,266,827 B2 9/2012 Dojan et al.
8,276,294 B2 10/2012 Polegato Moretti
8,277,719 B2 * 10/2012 Alderson ..... B29C 44/357 264/321
8,312,645 B2 11/2012 Dojan et al.
8,322,050 B2 12/2012 Lubart
8,333,024 B2 * 12/2012 Fallow ..... A43B 3/0042 36/102
8,343,404 B2 1/2013 Meli et al.
8,388,791 B2 3/2013 Dojan et al.
8,468,720 B2 * 6/2013 Sokolowski ..... A43B 13/125 36/25 R
8,490,299 B2 7/2013 Dua et al.
8,516,723 B2 8/2013 Ferrigan et al.
8,544,197 B2 10/2013 Spanks et al.
8,631,589 B2 1/2014 Dojan
8,661,564 B2 3/2014 Dodd
8,707,582 B2 * 4/2014 Klassen ..... A43B 13/181 267/161
8,732,982 B2 5/2014 Sullivan et al.
D707,934 S 7/2014 Petrie et al.
8,844,170 B2 * 9/2014 Ferrigan ..... A43B 3/0042 36/102
D716,027 S 10/2014 Kirschner et al.
D717,034 S 11/2014 Bramani et al.
8,919,016 B2 * 12/2014 McDonald ..... A43B 1/0063 36/102
8,961,733 B2 2/2015 Dodd
9,003,678 B2 * 4/2015 Wan ..... A43B 13/141 36/25 R
2002/0166262 A1 11/2002 Hernandez
2004/0181972 A1 9/2004 Csorba
2007/0213838 A1 * 9/2007 Hengelmolen ..... A61F 2/91 623/23.71
2007/0240333 A1 10/2007 Le et al.
2008/0011021 A1 * 1/2008 Starbuck ..... D04B 21/06 66/170
2008/0216357 A1 9/2008 Fogg et al.
2008/0250673 A1 10/2008 Andrews et al.
2008/0289214 A1 11/2008 Aveni
2009/0064536 A1 3/2009 Klassen et al.
2009/0064540 A1 3/2009 Sokolowski et al.
2009/0119820 A1 5/2009 Bentham et al.
2009/0151195 A1 6/2009 Forstrom et al.
2009/0178301 A1 7/2009 Dojan et al.
2009/0183392 A1 7/2009 Shane
2009/0276933 A1 11/2009 Dodd
2009/0307932 A1 12/2009 Kirby et al.
2010/0029796 A1 2/2010 Alderson et al.
2010/0043255 A1 2/2010 Trevino
2010/0095551 A1 * 4/2010 Gupta ..... A43B 7/144 36/29
2010/0126041 A1 5/2010 Francis
2010/0139122 A1 6/2010 Zanatta
2010/0170117 A1 7/2010 Kim
2010/0236098 A1 9/2010 Morgan
2011/0059291 A1 * 3/2011 Boyce ..... C08J 5/00 428/136
2011/0099845 A1 5/2011 Miller
2011/0119956 A1 5/2011 Borel et al.
2011/0168313 A1 * 7/2011 Ma ..... B60C 7/14 152/302
2011/0192056 A1 8/2011 Geser et al.
2011/0247237 A1 * 10/2011 Jara ..... A43B 3/0036 36/103
2011/0247240 A1 10/2011 Eder et al.
2011/0282452 A1 * 11/2011 Koerner ..... A61L 27/50 623/16.11
2012/0021167 A1 * 1/2012 Plant ..... A41D 13/0156 428/116
2012/0023686 A1 2/2012 Huffa et al.
2012/0117826 A1 5/2012 Jarvis
2012/0124861 A1 5/2012 Losani
2012/0124865 A1 5/2012 Opie et al.
2012/0129416 A1 5/2012 Anand et al.
2012/0159810 A1 6/2012 Klassen
2012/0174432 A1 7/2012 Peyton
2012/0181896 A1 7/2012 Kornbluh et al.
2012/0198720 A1 8/2012 Farris et al.
2012/0210607 A1 8/2012 Avar et al.
2012/0233878 A1 9/2012 Hazenberg et al.
2012/0266492 A1 10/2012 Youngs et al.
2012/0272550 A1 11/2012 Parce
2012/0315456 A1 12/2012 Scarpa et al.
2013/0000152 A1 1/2013 Cooper et al.
2013/0071583 A1 3/2013 Evans et al.
2013/0081305 A1 4/2013 Byrne
2013/0104428 A1 5/2013 O'Brien et al.

(56) References Cited

U.S. PATENT DOCUMENTS

| | | | | |
|---|---|---|---|---|
| 2013/0160324 | A1 | 6/2013 | Peyton et al. | |
| 2013/0160328 | A1 | 6/2013 | Hatfield et al. | |
| 2013/0219636 | A1 | 8/2013 | Dojan et al. | |
| 2013/0239444 | A1 | 9/2013 | Polegato Moretti | |
| 2013/0276333 | A1 | 10/2013 | Wawrousek et al. | |
| 2013/0284732 | A1 | 10/2013 | Van Schaftingen | |
| 2013/0340288 | A1 | 12/2013 | Baker et al. | |
| 2014/0053311 | A1* | 2/2014 | Nordstrom | A41D 1/00 2/69 |
| 2014/0053312 | A1 | 2/2014 | Nordstrom et al. | |
| 2014/0059734 | A1* | 3/2014 | Toronjo | A41D 31/005 2/69 |
| 2014/0090271 | A1* | 4/2014 | Hoffer | A43B 1/0009 36/29 |
| 2014/0101816 | A1* | 4/2014 | Toronjo | A41D 31/0011 2/69 |
| 2014/0157631 | A1 | 6/2014 | Dodd | |
| 2014/0165427 | A1 | 6/2014 | Molyneux et al. | |
| 2014/0173938 | A1 | 6/2014 | Beye et al. | |
| 2014/0237850 | A1 | 8/2014 | Hull | |
| 2014/0260281 | A1* | 9/2014 | Innes | F23R 3/002 60/752 |
| 2015/0007456 | A1* | 1/2015 | Klassen | A43B 13/181 36/102 |
| 2015/0075033 | A1 | 3/2015 | Cross et al. | |
| 2015/0075034 | A1 | 3/2015 | Cross et al. | |
| 2016/0025343 | A1* | 1/2016 | Bertoldi | F23R 3/002 60/722 |
| 2016/0025344 | A1* | 1/2016 | Bertoldi | B32B 3/10 428/613 |
| 2016/0040962 | A1* | 2/2016 | Rossow | B32B 5/06 89/36.02 |
| 2016/0046153 | A1* | 2/2016 | Yoo | B60C 7/10 152/1 |

FOREIGN PATENT DOCUMENTS

| | | | |
|---|---|---|---|
| GB | 2 147 792 | A | 5/1985 |
| GB | 2 455 167 | A | 6/2009 |
| GB | 2 463 446 | A | 3/2010 |
| JP | 2005-143637 | A | 6/2005 |
| KR | 101165793 | B1 | 7/2012 |
| TW | 201231283 | A | 8/2012 |
| WO | 03/022085 | A2 | 3/2003 |
| WO | 2007022338 | A1 | 2/2007 |
| WO | 2007/052054 | A1 | 5/2007 |
| WO | 2012/171911 | A1 | 12/2012 |
| WO | 2014187970 | | 11/2014 |
| WO | 2015/041796 | A1 | 3/2015 |
| WO | 2016007205 | A1 | 1/2016 |
| WO | 2016032626 | A1 | 3/2016 |

OTHER PUBLICATIONS

International Search Report and Written Opinion mailed Apr. 6, 2016 in PCT Application No. PCTUS2015/066883.

International Search Report and Written Opinion mailed Apr. 6, 2016 in PCT Application No. PCTUS2015/066923.

International Search Report and Written Opinion mailed Apr. 13, 2016 in PCT Application No. PCTUS2015/066895.

Taiwanese Office Action dated Mar. 1, 2016 in Taiwanese Patent Application No. 103131046.

International Search Report and Written Opinion mailed Mar. 18, 2016 in PCT Application No. PCTUS2015/066901.

International Search Report and Written Opinion mailed Mar. 18, 2016 in PCT Application No. PCTUS2015/066913.

International Preliminary Report on Patentability (including Written Opinion of the ISA) dated Mar. 22, 2016 in PCT Application No. PCTUS2014/052038.

International Search Report and Written Opinion mailed Mar. 18, 2016 in PCT Application No. PCTUS2015/066905.

International Search Report and Written Opinion mailed Dec. 4, 2014 in PCT/US2014/052038.

Non-Final Office Action mailed Mar. 26, 2015 for U.S. Appl. No. 14/030,002, filed Sep. 18, 2013.

U.S. Appl. No. 14/329,483, filed Jul. 11, 2014.

U.S. Appl. No. 14/470,067, filed Aug. 27, 2014.

U.S. Appl. No. 14/643,427, filed Mar. 10, 2015.

U.S. Appl. No. 14/643,254, filed Mar. 10, 2015.

U.S. Appl. No. 14/643,121, filed Mar. 10, 2015.

U.S. Appl. No. 14/643,089, filed Mar. 10, 2015.

U.S. Appl. No. 14/643,161, filed Mar. 10, 2015.

International Search Report and Written Opinion mailed Oct. 14, 2015 in PCT/US2015/038958.

* cited by examiner

FOOTWEAR SOLES WITH AUXETIC MATERIAL

CROSS-REFERENCE TO RELATED APPLICATION(S)

This application is a Continuation-In-Part Application of Cross, U.S. Pat. No. 9,402,439, issued on Aug. 2, 2016, titled "Auxetic Structures and Footwear with Soles Having Auxetic Structures" (now U.S. patent application Ser. No. 14/030,022, and filed on Sep. 18, 2013), the disclosure of which is hereby incorporated by reference in its entirety.

BACKGROUND

The present embodiments relate generally to articles of footwear that may be used for athletic or recreational activities such as running, jogging, training, hiking, walking, volleyball, handball, tennis, lacrosse, basketball and other similar activities.

Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The upper generally includes an ankle opening to allow a wearer to insert the wearer's foot into the article of footwear. The upper may incorporate a fastening system, such as a lacing system, a hook-and-loop system, or other system for fastening the upper over a wearer's foot. The upper may also include a tongue that extends under the fastening system to enhance adjustability of the upper and increase the comfort of the footwear.

The sole structure is attached to a lower portion of the upper and is positioned between the upper and the ground. Generally, the sole structure may include an insole, a midsole, and an outsole. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The midsole may be formed of a polymer foam material, such as a polyurethane (PU), a thermoplastic polyurethane (TPU) or ethylvinylacetate (EVA), that attenuates ground impact forces. In some cases, the midsole may incorporate sealed and fluid-filled bladders that further attenuate and distribute ground impact forces. The outsole may be made of a durable and wear resistant material, and it may carry a tread pattern to provide traction against the ground or playing surface. For some activities, the outsole may also use cleats, spikes or other protrusions to engage the ground or playing surface and thus provide additional traction.

SUMMARY

This summary is intended to provide an overview of the subject matter of this patent, and is not intended to identify essential elements or key elements of the subject matter, nor is it intended to be used to determine the scope of the claimed embodiments. The proper scope of this patent may be ascertained from the claims set forth below in view of the detailed description below and the drawings.

In one aspect, a structure comprises of a group of members divided into a first group and a second group. The structure further includes a group of connecting portions, a group of interior apertures, and a group of peripheral apertures. The first group comprises of a first exterior member connected to a first interior member at a first connecting portion. The first interior member is connected to a second interior member at a second connecting portion and forms a first peripheral aperture. The second interior member is connected to a second exterior member at a third connecting portion. The second group comprises of a third exterior member connected to a third interior member at fourth connecting portion. The third interior member is connected to a fourth interior member at a fifth connecting portion and forms a second peripheral aperture. The fourth interior member is connected to a fourth exterior member at a sixth connecting portion. The first group is connected to the second group at a seventh connecting portion connecting the first exterior member with the third exterior member and which forms a third peripheral aperture, at an eighth connecting portion connecting the first interior member with the third interior member, at a ninth connecting portion connecting the second interior member with the fourth interior member, and at a tenth connecting portion connecting the second exterior member with the fourth exterior member and which forms a fourth peripheral aperture. The first exterior member, the first interior member, the third exterior member, and the third interior member circumscribe a first interior aperture oriented in a first direction. The second interior member, the second exterior member, the fourth interior member, and the fourth exterior member circumscribe a second interior aperture oriented in the first direction. The first interior member, the second interior member, the third interior member, and the fourth interior member circumscribe a third interior aperture oriented in a second direction. The first direction is perpendicular to the second direction. The third interior aperture has a first aperture diagonal oriented in the first direction, and a second aperture diagonal oriented in the second direction. The structure having a thickness that is greater than the first aperture diagonal.

In another aspect, an article of footwear includes an upper and a sole structure secured to the upper. The sole structure comprises of a group of members divided into a first group and a second group. The structure further includes a group of connecting portions, a group of interior apertures, and a group of peripheral apertures. The first group comprises of a first exterior member connected to a first interior member at a first connecting portion. The first interior member is connected to a second interior member at a second connecting portion and forms a first peripheral aperture. The second interior member is connected to a second exterior member at a third connecting portion. The second group comprises of a third exterior member connected to a third interior member at fourth connecting portion. The third interior member is connected to a fourth interior member at a fifth connecting portion and forms a second peripheral aperture. The fourth interior member is connected to a fourth exterior member at a sixth connecting portion. The first group is connected to the second group at a seventh connecting portion connecting the first exterior member with the third exterior member and which forms a third peripheral aperture, at an eighth connecting portion connecting the first interior member with the third interior member, at a ninth connecting portion connecting the second interior member with the fourth interior member, and at a tenth connecting portion connecting the second exterior member with the fourth exterior member and which forms a fourth peripheral aperture. The first exterior member, the first interior member, the third exterior member, and the third interior member circumscribe a first interior aperture oriented in a first direction. The second interior member, the second exterior member, the fourth interior member, and the fourth exterior member circumscribe a second interior aperture oriented in the first direction. The first interior member, the second interior member, the third interior member, and the fourth interior member circumscribe a third interior aperture oriented in a second direction. The first direction is perpendicular to the second direction. A first area of the first interior aperture increases when a tension is applied in a third direction, the third direction being in the plane formed by the first direction and the second direction. A second area of the second interior aperture increases when the tension is applied in the third direction. A third area of the third interior aperture increases when the tension is applied in the third direction.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
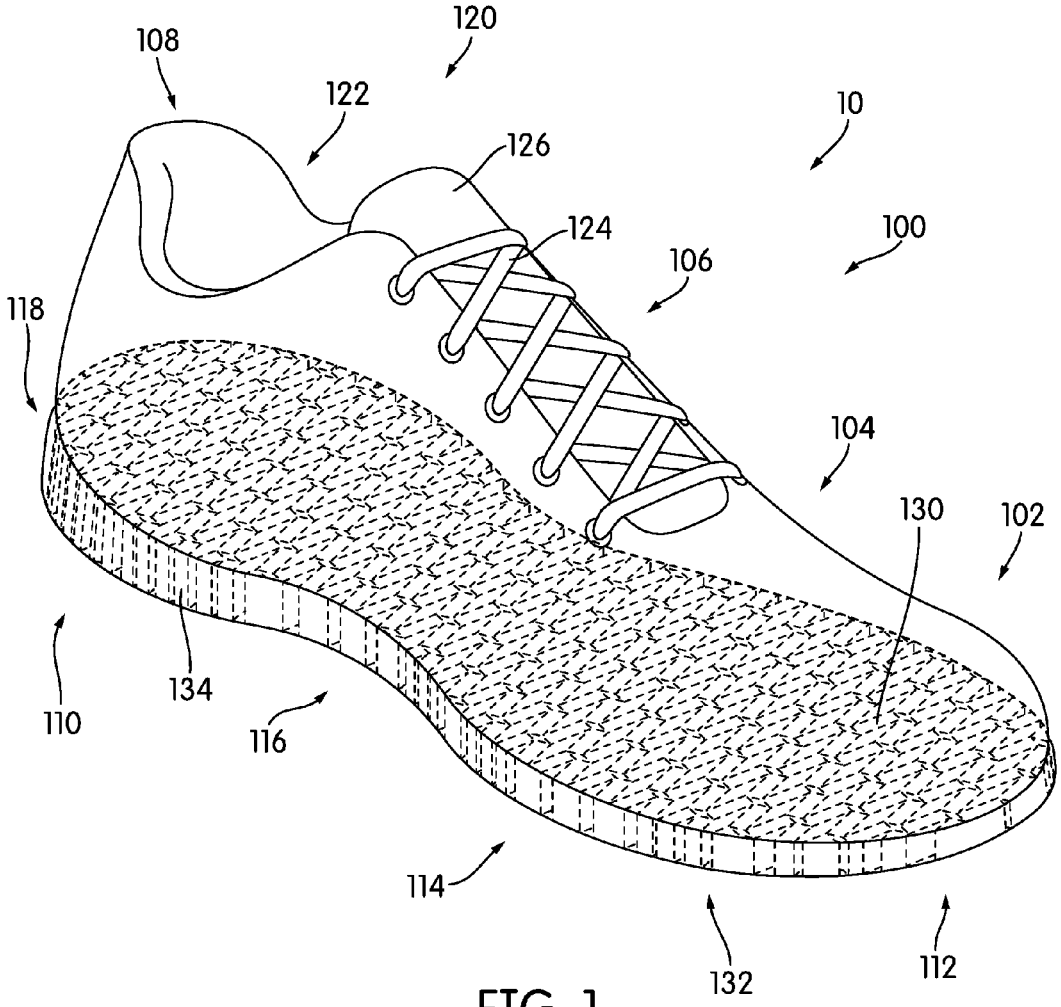
FIG. 1 is an isometric view of an embodiment of an article of footwear.

For clarity, the detailed descriptions herein describe certain exemplary embodiments, but the disclosure in this application may be applied to any article of footwear comprising certain of the features described herein and recited in the claims. In particular, although the following detailed description describes certain exemplary embodiments, it should be understood that other embodiments may take the form of other articles of athletic or recreational footwear.

For convenience and clarity, various features of embodiments of an article of footwear may be described herein by using directional adjectives such as top, bottom, medial, lateral, forward, rear, and so on. Such directional adjectives refer to the orientation of the article of footwear as typically worn by a wearer when standing on the ground, unless otherwise noted. The term "longitudinal" as used throughout this detailed description and in the claims may refer to a direction extending a length of the footwear. In some cases, the longitudinal direction may extend from a forefoot region to a heel region of the article of footwear. Also, the term "lateral" as used throughout this detailed description and in the claims may refer to a direction extending along a width of the article of footwear. In other words, the lateral direction may extend between a lateral side and a medial side of the article of footwear. The term "proximal" may refer to a portion of an article of footwear that is closer to portions of a foot, for example, when the article of footwear is worn. Similarly, the term "distal" may refer to a portion of an article of footwear that is further from a portion of a foot when the article of footwear is worn. The use of these directional adjectives and the depiction of articles of footwear or components of articles of footwear in the drawings should not be understood as limiting the scope of this disclosure in any way.

The terms "top," "upper portion," "upper surface," and other similar terms refer to the portion of an object substantially furthest from the ground in a vertical direction, and the terms "bottom," "bottom surface", "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

FIG. 1 is a schematic diagram of a portion of a side perspective view of an article of footwear (article) 10 that may be used in a number of athletic or recreational activities such as running, walking, training, tennis, volleyball, tennis and racquetball. For reference purposes, upper 100 of article of footwear 10 may be generally described as having a toe region 102, a forefoot region 104, a midfoot region 106 and a heel region 108. Likewise, article 10 includes sole structure 110 that may generally be described as having a toe region 112, a forefoot region 114, a midfoot region 116 and a heel region 118. In some embodiments, sole structure 110 may further be characterized as having a top sole surface 130, a bottom sole surface 132 opposite the top sole surface 130, and side sole surface 134 disposed between the top sole surface 130 and the bottom sole surface 132.

Upper 100 of article 10 shown in FIG. 1 may be fabricated from any conventional or nonconventional materials, such as leather, woven or non-woven textiles or synthetic leather. Upper 100 has an ankle opening 120 in upper 100 to allow a wearer to insert his or her foot into the interior cavity 122 of upper 100. The wearer may then use lace 124 to close upper 100 over tongue 126 to fasten article 10 over his or her foot. Upper 100 also has sole structure 110 that is attached to upper 100 by any conventional method, such as stitching, stapling, gluing, fusing or welding or other known method for attaching a sole structure to an upper.

The term "sole structure", also referred to simply as "sole", herein shall refer to any combination that provides support for a wearer's foot and bears the surface that is in direct contact with the ground or playing surface, such as a single sole; a combination of an outsole and an inner sole;

a combination of an outsole, a midsole and an inner sole, and a combination of an outer covering, an outsole, a midsole and an inner sole.

Sole structure 110 as shown in FIG. 1 and as described further in detail below, has an auxetic structure. Articles of footwear having sole structures made from an auxetic structure are described in Cross, U.S. Pat. No. 9,402,439, issued on Aug. 2, 2016, titled "Auxetic Structures and Footwear with Soles Having Auxetic Structures" (now U.S. patent application Ser. No. 14/030,022, and on filed Sep. 18, 2013), referred to hereafter as the '022 application.

As described in the '002 application, auxetic materials have a negative Poisson's ratio, such that when they are under tension in a first direction, their dimensions increase both in the first direction and in a second direction orthogonal or perpendicular to the first direction. This property of an auxetic material is illustrated in FIGS. 2 through 9.

Figure 2:
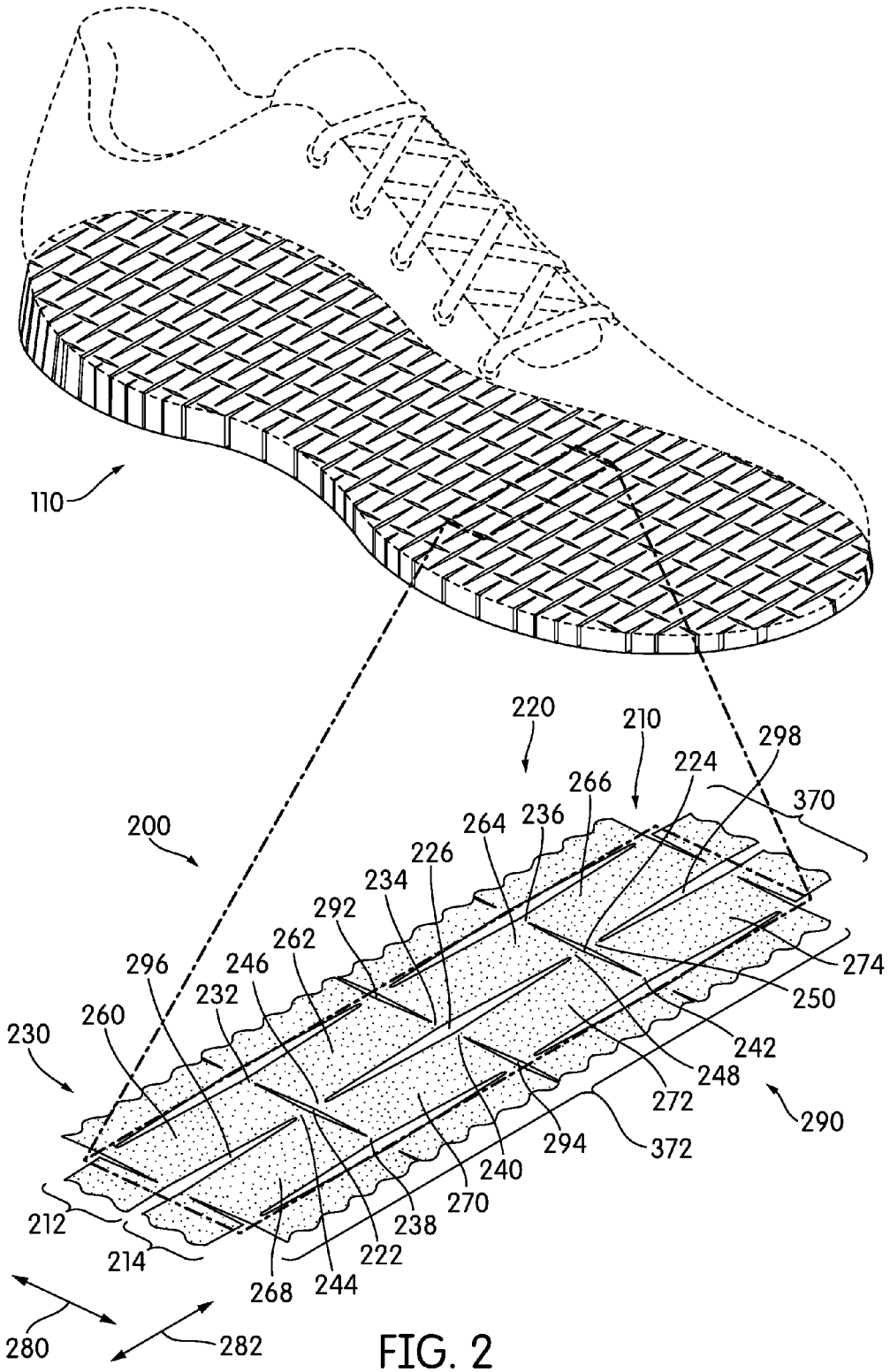
FIG. 2 is an isometric view of an embodiment of a sole structure.

FIG. 2 is a schematic isometric view of an example of a portion of sole structure 110 having an auxetic structure not under tension. As shown in the enlarged view, the portion of auxetic material 200 includes a group of members, also referred to simply as sole members or members 210 for purposes of convenience. In some embodiments, members 210 are joined at their vertices by connecting portions 230. In some embodiments, when sole structure 110 is not under tension in any direction, members 210 may have group length 370 and group width 372 (i.e., the group of members 210 collectively have group length 370 and group width 372).

For purposes of clarity, the embodiments discuss a subset of sole members 210 and their relative configuration, however it will be understood that these particular members are only meant to be a representation and sole structure 110 is comprised of many other members arranged in similar patterns. Moreover, members 210 of sole structure 110 may generally be tiled in a regular pattern comprised of smaller sets of members that have a configuration substantially similar to members 210.

In some embodiments, members 210 may further be delineated into sub-groups. In some embodiments, members 210 may be characterized as having a first group and a second group. In an exemplary embodiment, members 210 are characterized as having first longitudinal group 212 and second longitudinal group 214. That is, members of first longitudinal group 212 may share a common longitudinal position along first direction 280 of sole structure 110 and members of second longitudinal group 214 may share a common longitudinal position along first direction 280 of sole structure 110. It should be understood that division of members into longitudinal groups is used for purposes of clarity and other divisions of members are also possible. For example, in some other embodiments, members 210 may be characterized as having a first lateral group and a second lateral group oriented, where members of each group share a common lateral position along second direction 282 of sole structure 110. In some embodiments, first direction 280 may be orthogonal to second direction 282.

In the exemplary embodiment, first longitudinal group 212 may comprise of first exterior member 260, first interior member 262, second interior member 264, and second exterior member 266. In some embodiments, second longitudinal group 214 may comprise third exterior member 268, third interior member 270, fourth interior member 272, and fourth exterior member 274.

Some embodiments may include provisions for joining the group of members with each other. In other words, in some embodiments, connecting portions 230 may be associated with individual members from first longitudinal group 212, second longitudinal group 214, or both longitudinal groups to join the individual members at a common vertex. In an exemplary embodiment, first connecting portion 232 may join first exterior member 260 and first interior member 262. Further, second connecting portion 234 may join first interior member 262 with second interior member 264. Further, third connecting portion 236 may join second interior member 264 with second exterior member 266. Further, fourth connecting portion 238 may join third exterior member 268 with third interior member 270. Further, fifth connecting portion 240 may join third interior member 270 with fourth interior member 272. Further, sixth connecting portion 242 may join fourth interior member 272 with fourth exterior member 274.

In some embodiments, some connecting portions 230 may join individual members belonging to first longitudinal group 212 with second longitudinal group 214. In an exemplary embodiment, seventh connecting portion 244 may join first exterior member 260 with third exterior member 268. Further, eighth connecting portion 246 may join first interior member 262 with third interior member 270. Further, ninth connecting portion 248 may join second interior member 264 with fourth interior member 272. Further, tenth connecting portion 250 may join second exterior member 266 with fourth exterior member 274.

In some embodiments, the connections, between members of first longitudinal group 212, between members of second longitudinal group 214, and between members of first longitudinal group 212 with second longitudinal group 214 may define a group of interior apertures 220, also referred to simply as interior apertures 220. In some embodiments, interior apertures 220 may comprise of first interior aperture 222 oriented longitudinally along first direction 280, second interior aperture 224 also oriented longitudinally along first direction 280, and third interior aperture 226 oriented laterally along second direction 282.

Referring to FIG. 2, in some embodiments, first exterior member 260, first interior member 262, third exterior member 268 and third interior member 270, based on their location, geometry and common vertices may define and circumscribe first interior aperture 222. Further, second interior member 264, second exterior member 266, fourth interior member 272, and fourth exterior member 274, may define and circumscribe second interior aperture 224. Further, first interior member 262, second interior member 264, third interior member 270, and fourth interior member 272 may define and circumscribe third interior aperture 226.

In some embodiments, first interior aperture 222 and second interior aperture 224 may have the same size and shape. In some embodiments, third interior aperture 226 may have a different size but similar shape as first interior aperture 222 and second interior aperture 224. In some other embodiments, first interior aperture 222, second interior aperture 224, and third interior aperture 226 may have the same sizes and shapes. In still some other embodiments, first interior aperture 222, second interior aperture 224, and third interior aperture 226 may have different sizes and shapes. In an exemplary embodiment third interior aperture 226 has a larger size than first interior aperture 222 and second interior aperture 224, as shown in FIG. 2.

In some embodiments, the connections between members of first longitudinal group 212, the connections between members of second longitudinal group 214, and the connections between members of first longitudinal group 212 with second longitudinal group 214 may further define a group of peripheral apertures 290, also referred to simply as peripheral apertures 290. Peripheral apertures 290 may be disposed between members at a common connecting portion. In some embodiments, peripheral apertures 290 may be characterized by an angle, for example, when peripheral apertures 290 are formed by two edges connected at a single vertex (connecting portions). In still some other embodiments, peripheral apertures 290 may take on other shapes based on different geometries. It is understood that peripheral apertures 290 are not meant to define a location along a periphery of sole structure 110 but is merely meant to convey a descriptive term relative to their location to members 210 and interior apertures 220.

Referring to FIG. 2, in an exemplary embodiment, first interior member 262, second interior member 264, and second connecting portion 234 may define first peripheral aperture 292. Further, third interior member 270, fourth interior member 272, and fifth connecting portion 240 may define second peripheral aperture 294. Further, first exterior member 260, third exterior member 268, and seventh connecting portion 244 may define third peripheral aperture 296. Further, second exterior member 266, fourth exterior member 274, and tenth connecting portion 250 may define fourth peripheral aperture 298. In some embodiments, peripheral apertures 290 may all have uniform sizes and shapes. In some other embodiments, peripheral apertures 290 may have different sizes and different shapes.

In some embodiments, members 210 may have a substantially quadrilateral shape. In some embodiments, the shape may be in the form of a trapezoid. In an exemplary embodiment the shapes of members 210 are rectangles having substantially parallel opposite edges. In some other embodiments, the shapes may be squares having substantially parallel opposite edges that are also substantially equal in length. In still other embodiments, the shapes of members 210 could have any other polygonal or non-polygonal geometry (e.g., geometries comprised of contoured edges).

Figure 3:
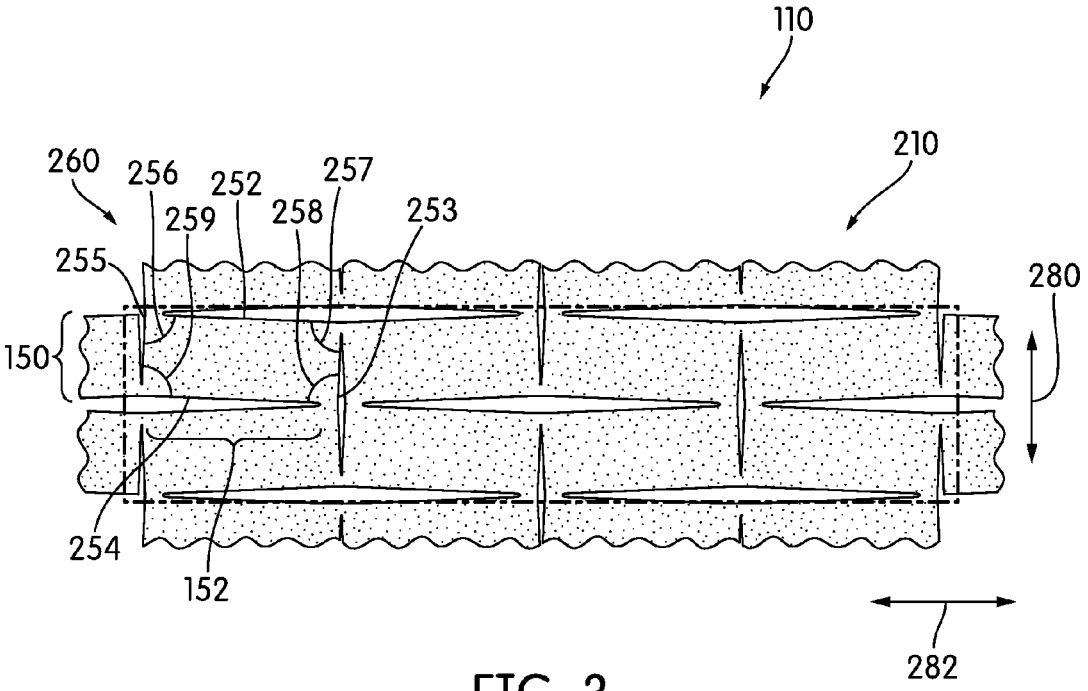
FIG. 3 is a schematic diagram of an embodiment of a portion of a sole structure.
Figure 4:
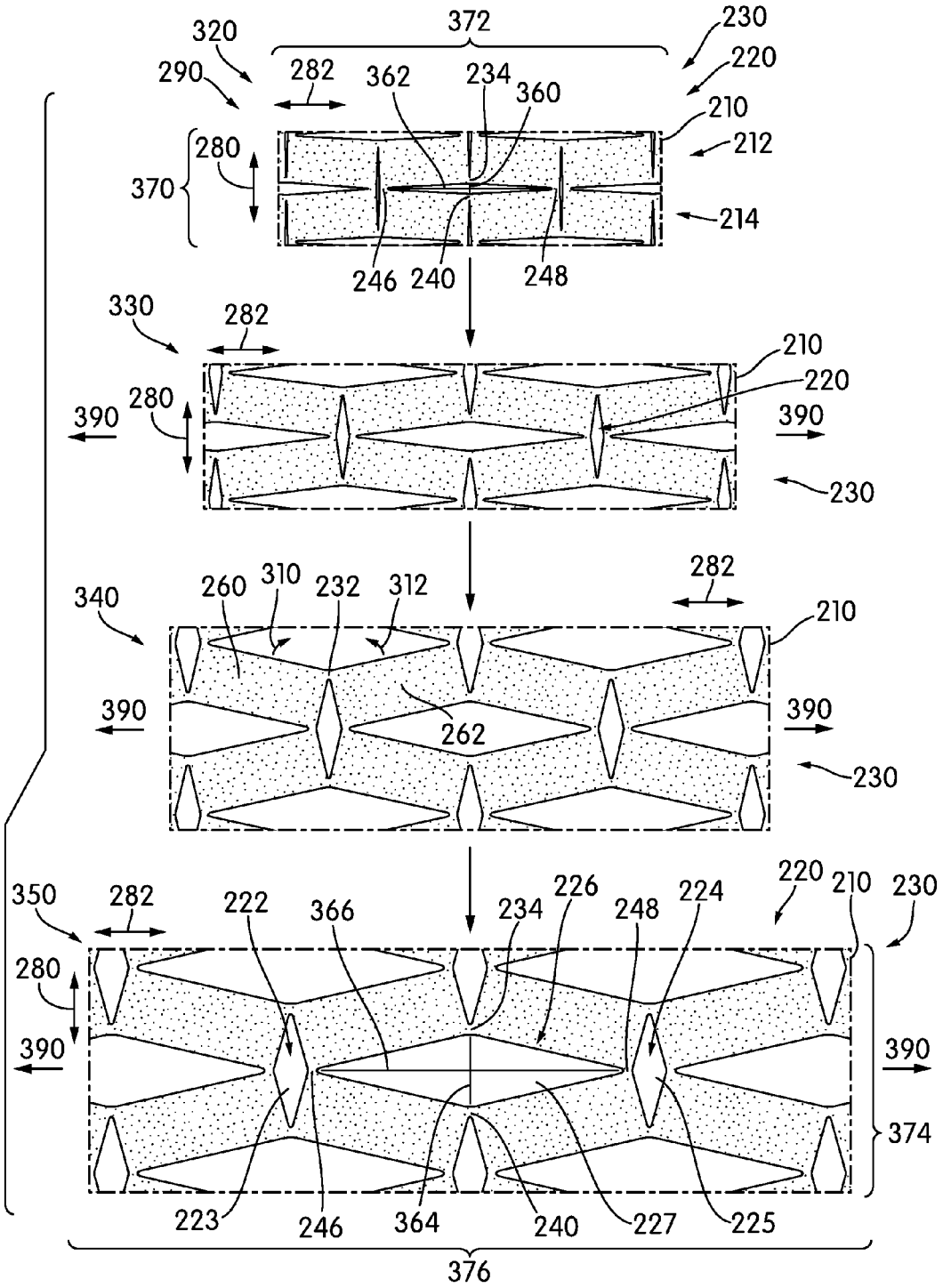
FIG. 4 shows a sequence of schematic diagrams of a top view of the portion of the sole structure of FIG. 2 in various states of tension.

As can be seen in FIG. 2, as well as in FIGS. 3-4, the embodiments comprise sole members 210 (e.g. first interior member 262) that may be connected to other sole members 210 at their vertices. That is, the sides or edges of each sole member may be free, or separated from nearby sole members 210. More specifically, each edge of a sole member may be bounded by a portion of an aperture (interior or peripheral).

FIG. 3 illustrates an isolated view of a portion of sole structure 110 of FIG. 2. In particular, FIG. 3 illustrates members 210 isolated from other members 210 comprising sole structure 110.

In some embodiments, members 210 may include a plurality of edges and interior angles. In some embodiments, first exterior member 260 may be comprised of first member edge 252, second member edge 253, third member edge 254, and fourth member edge 255. In some embodiments, first exterior member 260 may also include first member angle 256, second member angle 257, third member angle 258, and fourth member angle 259.

Some embodiments may have edges associated with a dimension such as a length or width. In some embodiments, second member edge 253 and fourth member edge 255 may be associated with a member length 150, along a longitudinal or first direction 280. In some embodiments, first member edge 252 and third member edge 254 may be associated with a member width 152, along a lateral or second direction 282. In some embodiments, the member length and the member width may be equal. In some other embodiments, the member length may be greater than the member width. In an exemplary embodiment, member width 152 is greater than member length 150.

In some embodiments, the shape of first exterior member 260 may include interior angles. In an exemplary embodiment, first exterior member 260 may include first member angle 256, second member angle 257, third member angle 258, and fourth member angle 259. In some embodiments, the member angles may be different from each other. In some other embodiments, all the member angles may be equal. In some other embodiments, the angles may be substantially 90 degrees. In still some other embodiments, only the opposite angles (i.e. non-consecutive) may be equal. In an exemplary embodiment, first member angle 256, second member angle 257, third member angle 258, and fourth member angle 259 are substantially the same because of the rectangular shape of first exterior member 260.

In some embodiments, members 210 may have opposite edges that are parallel. In some embodiments, first member edge 252 and third member edge 254 may be substantially parallel. In some embodiments, first member edge 252 and third member edge 254 may be substantially equal in length. In some embodiments, second member edge 253 and fourth member edge 255 may be substantially parallel. In some embodiments, second member edge 253 and fourth member edge 255 may be substantially equal in length. In some embodiments, second member edge 253 may not be equal in length to first member edge 252. In some other embodiments, first member edge 252 and third member edge 254 may not be substantially parallel. In still some other embodiments, first member edge 252 and third member edge 254 may not be substantially equal in length.

In some embodiments, a member may have edges that are substantially straight. In some other embodiments, the member has edges which may be non-linear, contoured, rounded, or wavy. In an exemplary embodiment, first member edge 252, second member edge 253, third member edge 254, and fourth member edge 255 are substantially straight to form a rectangular polygon.

Some embodiments may include provisions that allow members 210 to rotate in one or more directions with respect to each other when a force is applied to members 210. In some embodiments, connecting portions 230 may enable members of first longitudinal group 212 and second longitudinal group 214 to rotate (or pivot) about a common connecting portion along a plane of sole structure 110 by functioning as a hinge. In some embodiments, the rotation of members may provide sole structure 110 with auxetic properties.

FIG. 4 illustrates a schematic diagram of a sequence of configurations for members 210 under a force along second direction 282. In some embodiments, the geometry and arrangement of members 210 may provide auxetic properties to sole structure 110 when a force is applied.

As illustrated in FIG. 4, in an exemplary initial or first configuration 320, members 210 are shown to be under no tension, or in other words a resting state. Thus, in some embodiments, members 210 may collectively have an initial or first length 370 and an initial or first width 372. Further, peripheral apertures 290 may have an initial angle during this resting state.

In some embodiments, during this resting state, the connecting portions 230 joining members 210 that enclose or circumscribe interior apertures 220 may be separated from one another by certain distances. For example, in some embodiments, second connecting portion 234 and fifth connecting portion 240 may be separated by first separation distance 360. Further, in some embodiments, eighth connecting portion 246 and ninth connecting portion 248 may be separated by second separation distance 362.

In a second configuration 330, members 210 are shown to be under tension 390 causing interior apertures 220 to expand due to the auxetic structure. This is in turn causes the distances between connecting portions 230 to either increase or decrease depending on the geometry and orientation of members 210.

In a third configuration 340, as tension 390 continues increasing along second direction 282, interior apertures 220 further expand. In some embodiments, connecting portions 230, functioning as a hinges, enable members 210 to rotate in either a first rotational direction 310 or an opposite second rotational direction 312, thus causing the length and width of members 210 to increase.

In some embodiments, first connecting portion 232 may enable first exterior member 260 to rotate in a first rotational direction 310 towards first interior member 262. In some embodiments, first rotational direction 310 may be associated with a clockwise direction. In some embodiments, first connecting portion 232 may enable first interior member 262 to rotate towards first exterior member 260 in a second rotational direction 312. In some embodiments, second rotational direction 312 may be associated with a counter-clockwise direction, or a direction opposite of first rotational direction 310. The remaining members 210 may also rotate about adjoining connecting portions 230. It is to be understood that while one member rotates away in either first rotational direction 310 or second rotational direction 312, the other member sharing the common connecting portion will rotate in the opposite rotational direction.

In a final or fourth configuration 350, members 210 have rotated and interior apertures 220 have expanded as a result of tension 390 along second direction 282. Due to the geometric configurations of members 210, and their interconnection via connecting portions 230, tension 390 has transformed members 210 from their initial resting stage of first configuration 320. In some embodiments, tension 390 has resulted in members 210 having a different length 374 and width 376. In addition, the rotation of members 210 along first rotational direction 310 or second rotational direction 312 have increased the size and shape of interior apertures 220.

In some embodiments, tension 390 has changed the distance between connecting portions 230. For example, in some embodiments, second connecting portion 234 and fifth connecting portion 240, in the fourth configuration 350, are now separated by third separation distance 364. In some embodiments, third separation distance 364 of fourth configuration 350 may be greater than first separation distance 360 of first configuration 320. Further, eighth connecting portion 246 and ninth connecting portion 248, in the fourth configuration 350, are now separated by fourth separation distance 366. In some embodiments, fourth separation distance 366 may be less than second separation distance 362 of first configuration 320.

In some embodiments, as members 210 are transformed because of tension 390, interior apertures 220 are also transformed into a different shape and size from their initial shape and size during the resting state. In some embodiments, interior apertures 220 may take on a rhombic shape as members 210 are rotated due to tension 390. In some embodiments, this rotation may expand a cross-sectional area (area) associated with interior apertures 220. In one embodiment, as tension 390 is applied across members 210 along second direction 282, first area 223 of first interior aperture 222 increases as seen for example in FIG. 4. Correspondingly, tension 390 applied across members 210 along second direction 282 increases second area 225 of second interior aperture 224. Further, tension 390 applied across members 210 along second direction 282 increases third area 227 of third interior aperture 226. It is understood that due to the auxetic structure, in some other embodiments, tension applied across members 210 along first direction 280 may also result in the expansion of areas associated with interior apertures 220. It is further understood that tension 390 applied in any direction in a plane formed by the first direction 280 and the second direction 282 may increase the areas of interior apertures. In one embodiment, tension applied in a third direction in the plane formed by the first direction 280 and the second direction 282 increases first area 223, second area 225, and third area 227.

Figure 5:
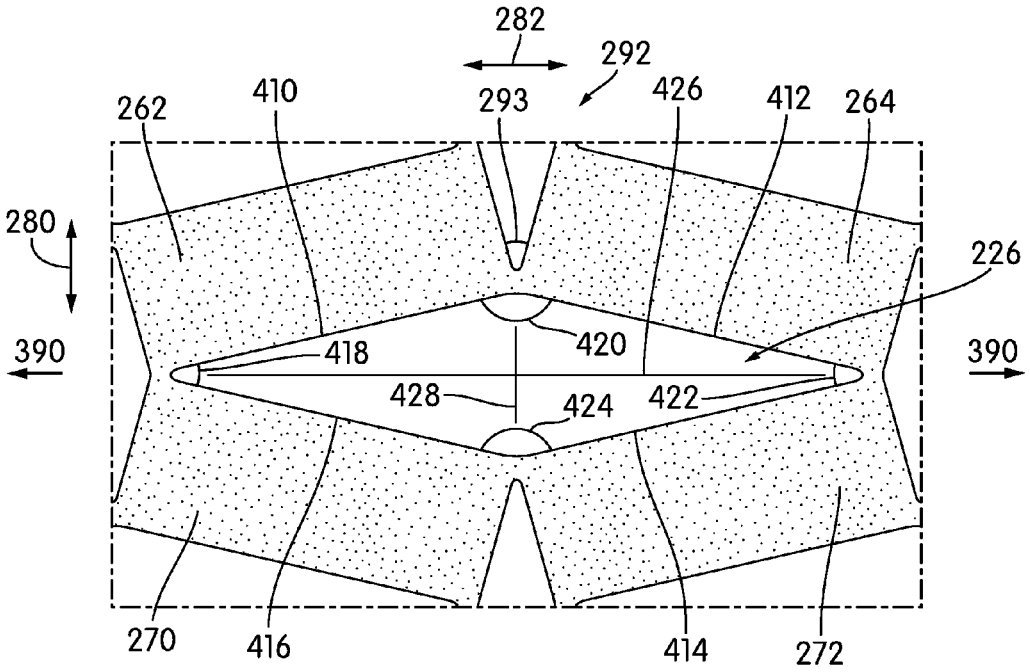
FIG. 5 is a schematic diagram of a top view of an embodiment of a portion of a sole structure.

Referring to FIG. 5, which is an enlarged partial schematic view of some members 210 in fourth configuration 350 of FIG. 4, third interior aperture 226, enclosed by first interior member 262, second interior member 264, third interior member 270, and fourth interior member 272, may include a first aperture edge 410, second aperture edge 412, third aperture edge 414, and fourth aperture edge 416. In some embodiments, first aperture edge 410 and opposite third aperture edge 414 may be parallel. In some embodiments, first aperture edge 410 and third aperture edge 414 may be equal in length. In some embodiments, second aperture edge 412 and opposite fourth aperture edge 416 may be parallel. In some embodiments, second aperture edge 412 and fourth aperture edge 416 may be equal in length. In some other embodiments, an aperture edge and its corresponding opposite aperture edge may not be parallel. In still other embodiments, an aperture edge and its opposite aperture edge may not be equal in length.

In some embodiments, third interior aperture 226 may include opposite angles which are substantially equal to each other. In some embodiments, third interior aperture 226 may include a first aperture angle 418, second aperture angle 420, third aperture angle 422, and fourth aperture angle 424. In an exemplary embodiment, first aperture angle 418 and opposite third aperture angle 422 may be equal. In another exemplary embodiment, second aperture angle 420 and opposite fourth aperture angle 424 may be equal. In still some other embodiments first aperture angle 418 and third aperture angle 422 may not be equal.

In some embodiments, the shape of third interior aperture 226 may include several diagonals joining the vertices of the opposite aperture angles. In an exemplary embodiment, third interior aperture 226 may include first aperture diagonal 426 and second aperture diagonal 428. First aperture diagonal 426 may connect and bisect first aperture angle 418 and third aperture angle 422. Second aperture diagonal 428 may connect and bisect second aperture angle 420 and fourth aperture angle 424. In some embodiments, first aperture diagonal 426 is perpendicular with second aperture diagonal 428. In some other embodiments, first aperture diagonal 426 is not perpendicular with second aperture diagonal 428. In at least some embodiments, first aperture diagonal 426 is longer than second aperture diagonal 428. In some other embodiments, second aperture diagonal 428 may be longer than first aperture diagonal 426.

In some embodiments, tension 390 may also transform peripheral apertures 290 from their initial size and shape during the resting stage to a different size and shape as members 210 are rotated. As shown in FIG. 5, first peripheral aperture 292 may increase as tension 390 is applied along second direction 282. Thus, first peripheral aperture 292 may be wider or have an angle 293 in fourth configuration 350, that is greater than the initial angle in first configuration 320.

Some embodiments may include provisions which provide members 210 with a prismatic geometry. In some embodiments, the members may be right prisms. In an exemplary embodiment, members 210 have a rectangular prism geometry bounded by a group of facets or surfaces.

Figure 6:
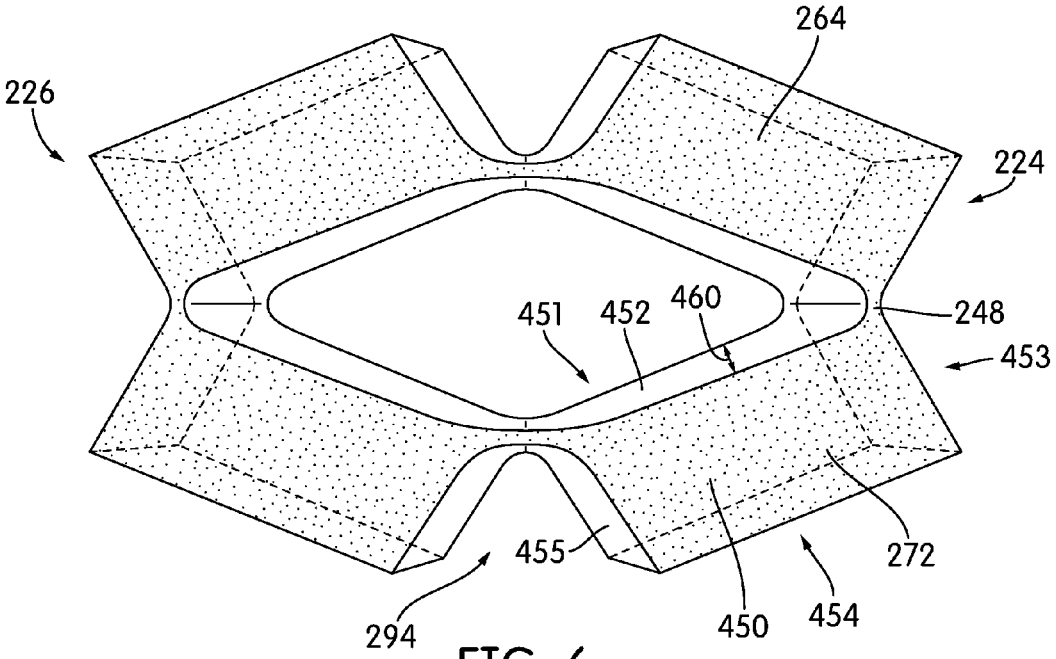
FIG. 6 is a schematic diagram of a top view of an embodiment of a portion of a sole structure.

Referring to FIG. 6, in an exemplary embodiment second interior member 264 and fourth interior member 272 may have rectangular prismatic geometries. In some embodiments, second interior member 264 and fourth interior member 272 may be joined at common vertices associated with ninth connecting portion 248. In some embodiments, second interior member 264 and fourth interior member 272 may be disposed between second interior aperture 224 (partially shown) and third interior aperture 226.

In some embodiments, fourth interior member 272 may have top surface 450 that forms part of the top surface of sole structure 110. In some embodiments, fourth interior member 272 may have a corresponding bottom surface 451, opposite top surface 450 that forms part of the bottom surface of sole structure 110, and is oriented towards a ground surface. In some embodiments, fourth interior member 272 may have first side surface 452 oriented facing towards third interior aperture 226. In some embodiments, fourth interior member 272 may have second side surface 453 oriented towards second interior aperture 224. In some embodiments, first side surface 452 may be disposed opposite of third side surface 454. In some embodiments, third side surface 454 may be disposed distally away from third interior aperture 226. In some embodiments, second side surface 453 may be disposed opposite fourth side surface 455. In some embodiments, fourth side surface 455 may be oriented towards second peripheral aperture 294. It is to be understood, that first side surface 452, second side surface 453, third side surface 454, and fourth side surface 455 are disposed and extend between top surface 450 and corresponding bottom surface 451.

In some embodiments, members 210 (and sole structure 110) may be associated with a thickness. In some embodiments, thickness 460 may be characterized as the distance between a top surface and a bottom surface of a member. In some embodiments, thickness 460 may be less than or equal to a member's length. In some other embodiments, thickness 460 may be less than or equal to a member's width. In some other embodiments, thickness 460 may be less than first aperture diagonal 426 of third interior aperture 226. In some other embodiments, thickness 460 may be greater than first separation distance 360 between second connecting portion 234 and fifth connecting portion 240 when members 210 are not in tension. In still some other embodiments, thickness 460 may be greater than one-half the size of the smaller sized member edge. For example, thickness 460 may be greater than one-half the size of second member edge 253. In still some other embodiments, thickness 460 may range from 0.10 mm to 50.0 mm. In one embodiment, thickness may be at least 5.0 mm.

In some embodiments, thickness 460 may be uniform as members 210 have a uniform distance between their top surface and the bottom surface. In some other embodiments, thickness 460 may be variable, as some members 210 have greater distances between the top surface and the bottom surface relative to other members 210. The variable thickness may allow for differing degrees of flexibility for sole structure 110. In an exemplary embodiment, members 210 (and sole structure 110) have a uniform thickness 460 as the distance between the top surface and the bottom surface of members 210 are substantially the same for the group of members 210, as illustrated in FIG. 6.

It is understood that in some embodiments, interior apertures 220 arranged on an outsole or the bottom surface of sole structure 110 match the interior apertures 220 of top surface of sole structure 110. In other words, interior apertures 220 expand (i.e. open) on both the top sole surface 130 and the bottom sole surface 132 and extend through thickness 460 as members 210 are rotated. In some embodiments, such apertures extending through sole structure 110 may be referred to as "through-hole" apertures.

In some embodiments, peripheral apertures 290 expand on both the top sole surface 130 and the bottom sole surface 132 as members 210 are rotated. When members 210 are not rotated (i.e. not in tension), interior apertures 220, and peripheral apertures 290 on the top sole surface 130 and the bottom sole surface 132 are not fully open, as shown for example in FIG. 3.

Figure 7:
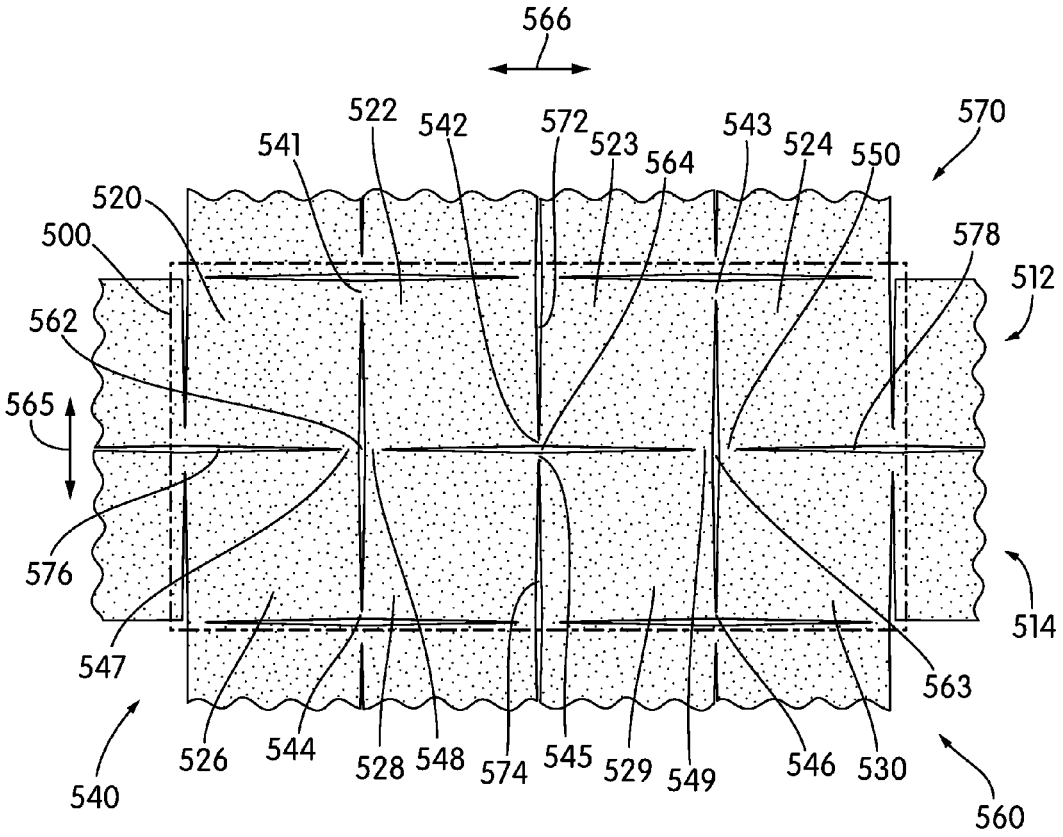
FIG. 7 is a schematic diagram of a top view of an embodiment of a portion of a sole structure.
Figure 8:
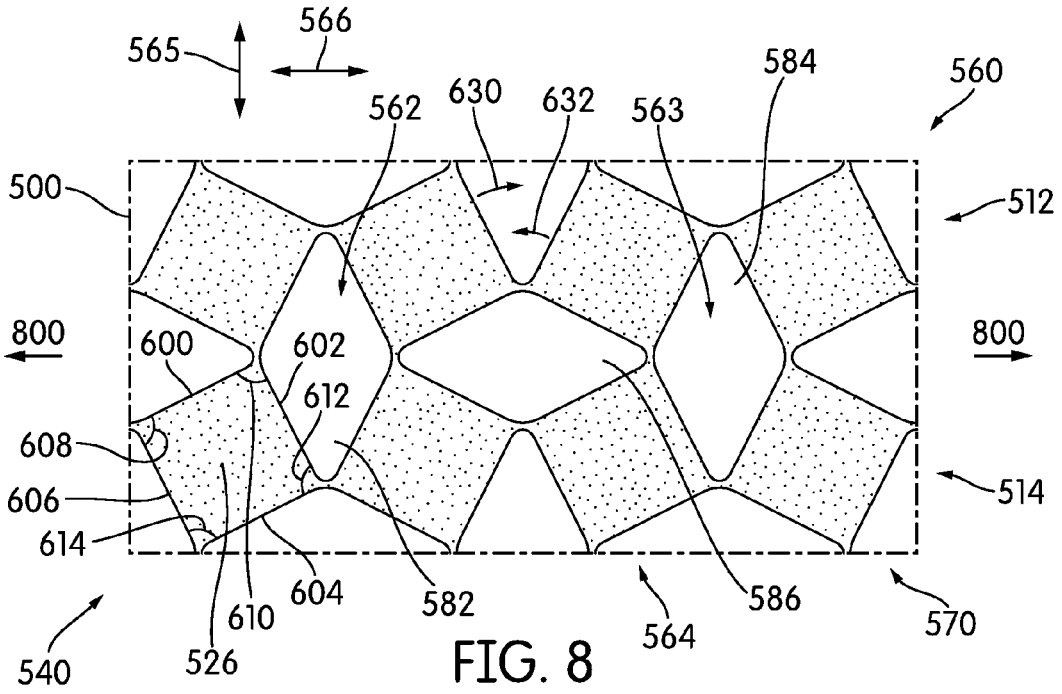
FIG. 8 is a schematic diagram of a top view of an embodiment of a portion of a sole structure.
Figure 9:
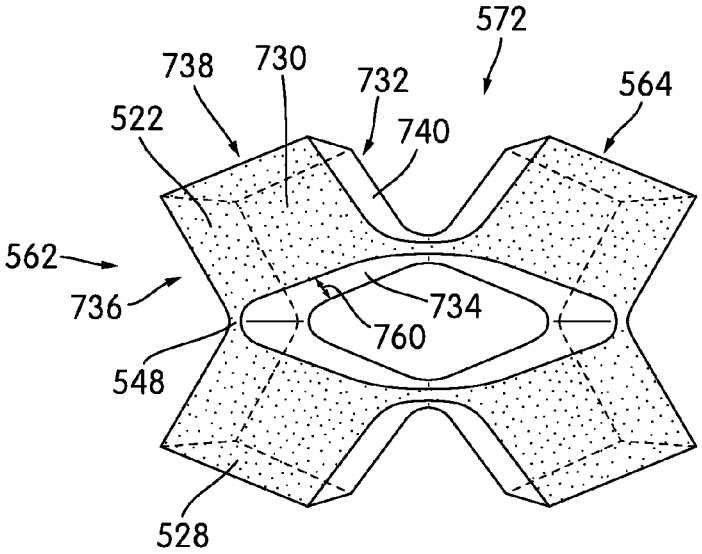
FIG. 9 is a schematic diagram of a top view of an embodiment of a portion of a sole structure.

FIGS. 7 through 9 illustrate another embodiment of a group of members (members) 500 that have a square geometry. In some embodiments, members 500 may be viewed as a portion of sole structure 110 for an article of footwear 10.

In some embodiments, members 500 are divided into a first group and a second group. In some embodiments, members 500 may be connected to other members by connecting portions 540. In some embodiments, members 500 with a square geometry may have edges of substantially equal length. Further, in some embodiments, members 500 may enclose a group of interior apertures 560, also referred to as simply interior apertures 560. Each of these features will be further explained in detail below.

Referring to FIG. 7, in an exemplary embodiment, members 500 are characterized as having first longitudinal group 512 and second longitudinal group 514. First longitudinal group 512 may include first exterior member 520 connected to first interior member 522 by first connecting portion 541. First interior member 522 may be connected to second interior member 523 by second connecting portion 542. Second interior member 523 may be connected to second exterior member 524 by third connecting portion 543.

In some embodiments, second longitudinal group 514 may comprise of several members 500 connected to each other by a connecting portion. In some embodiments, second longitudinal group 514 may include third exterior member 526 connected to third interior member 528 by fourth connecting portion 544. Third interior member 528 may be connected to fourth interior member 529 by fifth connecting portion 545. Fourth interior member 529 may be connected to fourth exterior member 530 by sixth connecting portion 546.

In some embodiments, members of first longitudinal group 512 may be connected with members of second longitudinal group 514 with connecting portions 540. In an exemplary embodiment, first exterior member 520 is connected to third exterior member 526 by seventh connecting portion 547. First interior member 522 may be connected to third interior member 528 by eighth connecting portion 548. Second interior member 523 may be connected to fourth interior member 529 by ninth connecting portion 549. Second exterior member 524 may be connected to fourth exterior member 530 by tenth connecting portion 550.

In some embodiments, the connections between members of first longitudinal group 512, between members of second longitudinal group 514, and between members of both first longitudinal group 512 with second longitudinal group 514 may define a group of interior apertures (interior apertures)

560. In an exemplary embodiment, first exterior member 520, first interior member 522, third exterior member 526, third interior member 528, along with first connecting portion 541, fourth connecting portion 544, seventh connecting portion 547, and eighth connecting portion 548 may define and circumscribe first interior aperture 562. In some embodiments, first interior aperture 562 may be oriented along first direction 565.

In a similar way, in some embodiments, second interior aperture 563 may be defined by second interior member 523, second exterior member 524, fourth interior member 529, and fourth exterior member 530, along with third connecting portion 543, sixth connecting portion 546, ninth connecting portion 549, and tenth connecting portion 550. In some embodiments, second interior aperture 563 may be oriented in the same direction as first interior aperture 562.

In some embodiments, third interior aperture 564 may be defined by first interior member 522, second interior member 523, third interior member 528 and fourth interior member 529 along with second connecting portion 542, fifth connecting portion 545, eighth connecting portion 548, and ninth connecting portion 549. In some embodiments, third interior aperture 564 may be oriented along a second direction 566. In some embodiments, second direction 566 may be orthogonal to first direction 565.

In some embodiments, the connections, between members of first longitudinal group 512, between members of second longitudinal group 514, and between members of first longitudinal group 512 with second longitudinal group 514 may further define peripheral apertures 570. In an exemplary embodiment, first peripheral aperture 572 may be disposed between first interior member 522 and second interior member 523. Second peripheral aperture 574 may be disposed between third interior member 528 and fourth interior member 529. Third peripheral aperture 576 may be disposed between first exterior member 520 and third exterior member 526. Fourth peripheral aperture 578 may be exposed between second exterior member 524 and fourth exterior member 530.

FIG. 8 illustrates an exemplary embodiment of members 500 that have been rotated with interior apertures 560 and peripheral apertures 570 expanded. In some embodiments, members 500 may include a plurality of edges. In some embodiments, third exterior member 526 may include first member edge 600, second member edge 602, third member edge 604, and fourth member edge 606.

In some embodiments, a member may have edges with different geometries. In some embodiments, a member may have edges which are substantially straight. In some other embodiments, a member has edges which may be non-linear, contoured, rounded, or wavy. In an exemplary embodiment, first member edge 600, second member edge 602, third member edge 604, and fourth member edge 606 are substantially straight forming a polygon with a square geometry.

In some embodiments, a member may have edges which are substantially equal in length. In some embodiments, a member may have non-consecutive edges that are parallel with each other. In an exemplary embodiment, first member edge 600, second member edge 602, third member edge 604, and fourth member edge 606 are substantially equal in length. Further, first member edge 600 and third member edge 604, second member edge 602 and fourth member edge 606 are substantially parallel thus providing a substantially square shape.

In some embodiments, the shape of a member may include interior angles. In some embodiments, third exterior member 526 may further comprise of first member angle 608, second member angle 610, third member angle 612, and fourth member angle 614. In some embodiments, first member angle 608, second member angle 610, third member angle 612, and fourth member angle 614 may be substantially equal. In some other embodiments, first member angle 608, second member angle 610, third member angle 612, and fourth member angle 614 may have different angle measurements relative to each other. In an exemplary embodiment, first member angle 608, second member angle 610, third member angle 612, and fourth member angle 614 are all substantially 90 degrees.

In some embodiments, connecting portions 540, between the members of first longitudinal group 512, between members of second longitudinal group 514, and between the members of first longitudinal group 512 and second longitudinal group 514 allow members 500 to rotate in one or more directions with respect to each other when a tension is applied. In other words, connecting portions 540 allow members 500 to rotate about a common connecting portion along a plane of sole structure 110 by functioning as a hinge.

In some embodiments, members 500 may rotate in a clockwise or first rotational direction 630 when tension 800 is applied in second direction 566 as shown in FIG. 8. In some embodiments, members 500 may rotate in a counter-clockwise or second rotational direction 632 also illustrated in FIG. 8. In some embodiments, the rotation of members 500 about a common connecting portion in first rotational direction 630 and second rotational direction 632 provides a sole structure with auxetic properties.

In some embodiments, as members 500 are rotated, interior apertures 560 are also transformed into a different shape and size from their initial shape and size during their resting state. In some embodiments, interior apertures 560 may take on a rhombic shape as members 500 are rotated. In some embodiments, this rotation may expand interior apertures 560 and a cross-sectional area associated with interior apertures 560. In one embodiment, as tension 800 is applied across members 500 along second direction 566 first area 582 of first interior aperture 562 increases as seen for example in FIG. 8. Correspondingly, tension 800 applied across members 500 along second direction 566 increases second area 584 of second interior aperture 563. Further, tension 800 applied across members 500 along second direction 566 increases third area 586 of third interior aperture 564. It is understood that due to the auxetic structure, in some other embodiments, tension applied across members 500 along first direction 565 may also result in the expansion of areas associated with interior apertures 560.

Some embodiments may have provisions that allow members 500 of first longitudinal group 512 and second longitudinal group 514 to have a prismatic geometry. In an exemplary embodiment, members 510 have a cubic geometry, bounded by a group of facets or surfaces.

FIG. 9 shows an enlarged partial schematic view of some members 500 fully expanded. In some embodiments, first interior member 522 and third interior member 528 may be joined at vertices associated with eighth connecting portion 548. Further, first interior member 522 and third interior member 528 may be disposed between first interior aperture 562 (partially shown) and third interior aperture 564. In some embodiments, first interior member 522 may have a top facet or surface 730 that forms part of the top surface of sole structure 110. In some embodiments, first interior member 522 may have a corresponding bottom surface 732 opposite top surface 730 that forms part of the bottom surface of sole structure 110, and is oriented towards a ground surface.

In some embodiments, first interior member 522 may have a first side surface 734 disposed facing towards third interior aperture 564. In some embodiments, first interior member 522 may have a second side surface 736 disposed facing towards first interior aperture 562. In some embodiments, first side surface 734 may be disposed opposite third side surface 738. In some embodiments, second side surface 736 may be disposed opposite fourth side surface 740. In some embodiments, fourth side surface 740 may be disposed facing towards first peripheral aperture 572. It is to be understood, that first side surface 734, second side surface 736, third side surface 738, and fourth side surface 740 are disposed and extend between top surface 730 and corresponding bottom surface 732.

In some embodiments, members 500 (and sole structure 110) may be associated with a thickness 760. Thickness 760 may be characterized as the distance between a top surface and a bottom surface of a member. In some embodiments, thickness 760 may be less than or equal to a member's length. In some other embodiments, thickness 760 may be less than or equal to a member's width. In some other embodiments, thickness 760 may be greater than a members' length. In still some other embodiments, thickness 760 may be greater than a member's width. In an exemplary embodiment, thickness 760 of members 500 is less than the member's width and the member's length, as shown in FIG. 9.

In some embodiments, thickness 760 may be uniform as members 500 have uniform distance between the top surface and the bottom surface. In some other embodiments, thickness 760 may be variable, as some members 500 have greater distances between the top surface and the bottom surface relative to other members 500. The variable thickness may allow for differing degrees of flexibility for sole structure 110. In an exemplary embodiment, members 500 (and sole structure 110) have a uniform thickness 760 as the distance between the top surface and the bottom surface are substantially the same for the group of members 500, as illustrated in FIG. 9.

It is understood that in some embodiments, interior apertures 560 arranged on an outsole or bottom sole surface 132 of sole structure 110 match the interior apertures 560 of top sole surface 130 of sole structure 110. In other words, interior apertures 560 expand (i.e. open) on both top sole surface 130 and bottom sole surface 132 as members 500 are rotated (i.e. sole structure 110 is in a tensioned state). In some embodiments, such apertures may be referred to as "through-hole" apertures.

In some embodiments, peripheral apertures 570 expand on both top sole surface 130 and bottom sole surface 132 of sole structure 110 as members 500 are rotated. When members 500 are not rotated (i.e. not in tension), interior apertures 560, and peripheral apertures 570 on top sole surface 130 and bottom sole surface 132 of sole structure 110 are not fully open, as shown for example in FIG. 7.

Figure 10:
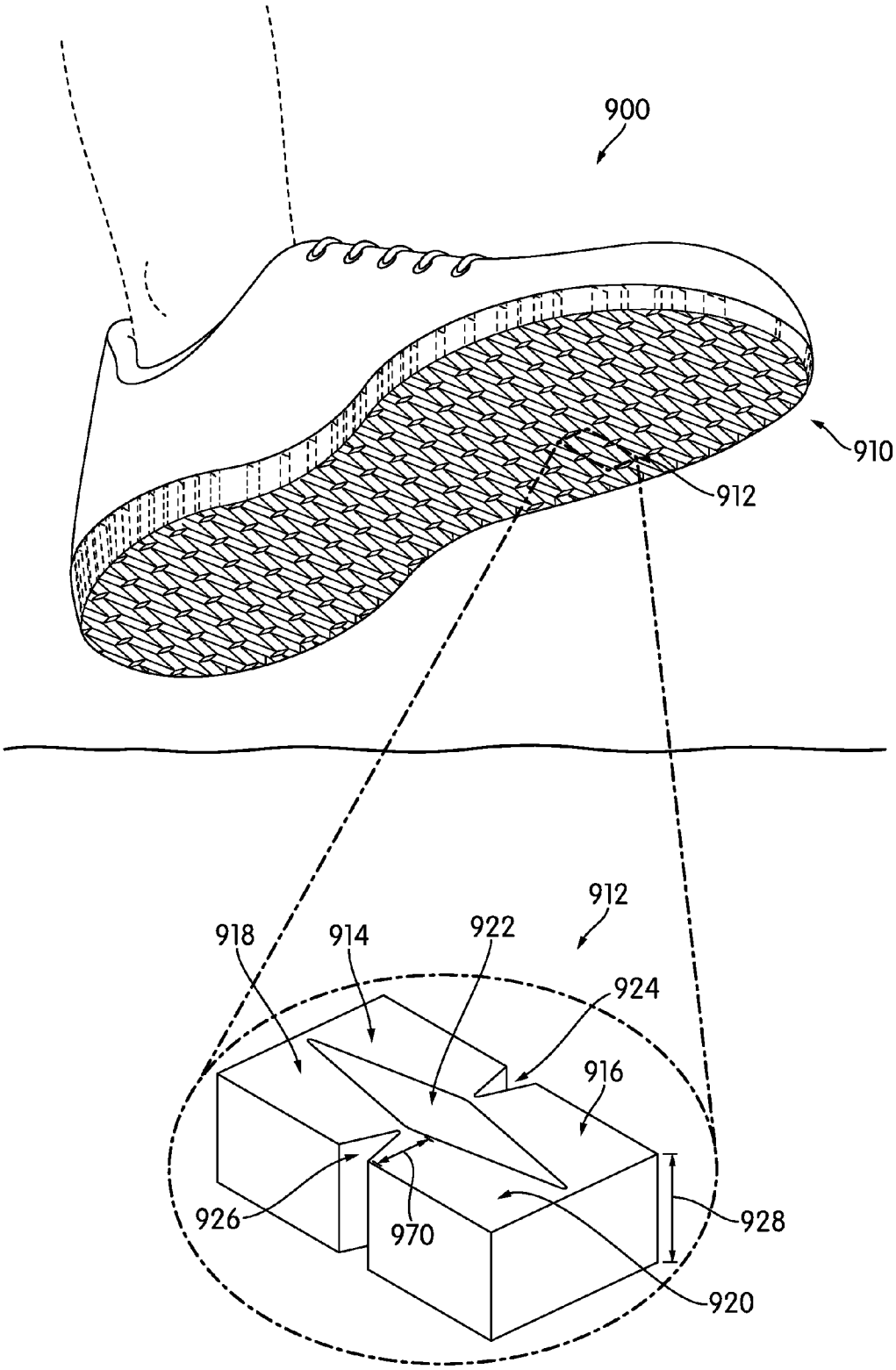
FIG. 10 is a schematic view of a sole structure in a non-compressed configuration.
Figure 11:
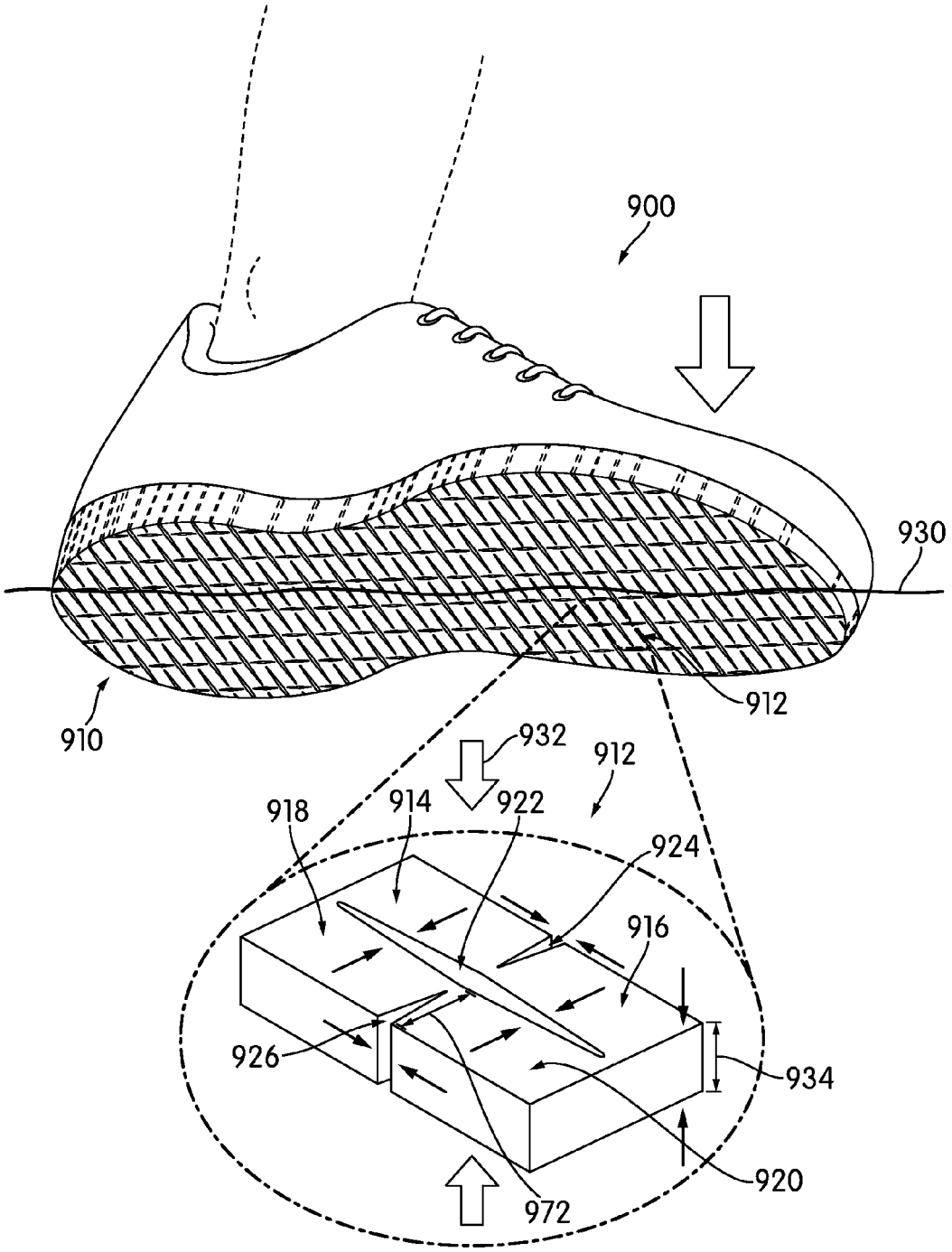
FIG. 11 is a schematic view of a sole structure in a compressed configuration.

In some embodiments, an article of footwear with a sole structure having the components illustrated and described in FIGS. 1 through 9, may improve cushioning effects as the sole structure contacts a ground surface. FIGS. 10 and 11 illustrate how the members and apertures may change under applied compressive forces, generally applied in the vertical direction.

As shown in FIG. 10, article 900 has sole structure 910 with members 912 similar to the size and shape of the components described in FIGS. 2 through 6. For purposes of illustration, the enlarged view of FIG. 10 shows several members and apertures in isolation from the other members and apertures. In particular, first interior member 914, second interior member 916, third interior member 918, and fourth interior member 920 can be seen with no compressive forces applied. Further, interior aperture 922, first peripheral aperture 924 and second peripheral aperture 926 may be initially open. In other words, members 912 may be in a rotated configuration as explained previously. In some embodiments, during this uncompressed state, members 912 may have a first thickness 928. In some embodiments, first thickness 928 may be uniform throughout sole structure 910. In some other embodiments, as explained previously, first thickness 928 may vary.

Referring to FIG. 11, as article 900 with sole structure 910 contacts ground surface 930, compressive forces 932 are applied in a vertical direction. In some embodiments, compressive forces 932 will compress members 912 so that the thickness of members 912 is decreased to second thickness 934, which is substantially less than first thickness 928. In at least some embodiments, as members 912 undergo compression they may partially expand in the horizontal directions due to mass conservation (i.e., as the material dimensions are reduced in the vertical direction the material dimensions are increased in the horizontal directions). This may further cause one or more apertures to decrease in size. For example, interior aperture 922 may shrink in size (e.g., in cross-sectional area). Likewise, first peripheral aperture 924 and second peripheral aperture 926 may also may shrink in size.

As each individual sole member expands horizontally under compressive forces, the surface area of each sole member in contact with a ground surface may increase. For example, a length 970 of fourth interior member 920 in the un-compressed state of FIG. 10 may be increased to a length 972 in the compressed state of FIG. 11. This may allow for increased traction with a ground surface as an article contacts the ground and compresses slightly.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear comprising an upper and a sole structure;

the upper comprising a different material than the sole structure, wherein the upper is attached to the sole structure by at least one of stitching, stapling, gluing, fusing, or welding;

the sole structure comprising:

a group of members comprised of a first group and a second group;

the sole structure further includes a group of connecting portions and a group of interior apertures;

the first group comprises a first exterior member connected to a first interior member at a first connecting portion, the first interior member connected to a second interior member at a second connecting portion forming a first peripheral aperture, and the second interior member connected to a second exterior member at a third connecting portion;

the second group comprises a third exterior member connected to a third interior member at a fourth connecting portion, the third interior member connected to a fourth interior member at a fifth connecting portion forming a second peripheral aperture, and the fourth interior member connected to a fourth exterior member at sixth connecting portion;

wherein the first group is connected to the second group at a seventh connecting portion connecting the first exterior member and the third exterior member and forming a third peripheral aperture, at an eighth connecting portion connecting the first interior member and the third interior member, at a ninth connecting portion connecting the second interior member and the fourth interior member, and at a tenth connecting portion connecting the second exterior member and the fourth exterior member and forming a fourth peripheral aperture;

wherein the first exterior member, the first interior member, the third exterior member, and the third interior member circumscribe a first interior aperture oriented in a first direction;

wherein the second interior member, the second exterior member, the fourth interior member, and the fourth exterior member circumscribe a second interior aperture oriented in the first direction;

wherein the first interior member, the second interior member, the third interior member, and the fourth interior member circumscribe a third interior aperture oriented in a second direction;

wherein the first direction is perpendicular to the second direction;

wherein a first area of the first interior aperture increases when a tension is applied across the group of members in a third direction, the third direction being a direction in a plane formed by the first direction and the second direction;

wherein a second area of the second interior aperture increases when the tension is applied across the group of members in the third direction;

wherein a third area of the third interior aperture increases when the tension is applied across the group of members in the third direction;

wherein each of the first interior member, the second interior member, the third interior member, the fourth interior member, the first exterior member, the second exterior member, the third exterior member, and the fourth exterior member has a member width oriented along the second direction and a member length oriented along the first direction;

wherein each of the first interior member, the second interior member, the third interior member, the fourth interior member, the first exterior member, the second exterior member, the third exterior member, and the fourth exterior member is in a shape of a rectangle having substantially parallel opposite edges, and wherein the member width is greater than the member length.

2. The article of footwear according to claim 1, wherein at least one member of the group of members comprises of a top surface, a bottom surface opposite the top surface, a first surface disposed facing towards at least one interior aperture, a second surface disposed facing towards at least one peripheral aperture, a third surface opposite the first surface, and a fourth surface opposite the second surface.

3. The article of footwear according to claim 2, wherein the first surface, the second surface, the third surface, and the fourth surface are disposed between the top surface and the bottom surface.

4. The article of footwear according to claim 3, wherein the second connecting portion and the fifth connecting portion are spaced apart a first distance from each other in a first configuration; and wherein the eighth connecting portion and the ninth connecting portion are spaced apart a second distance from each other in the first configuration.

5. The article of footwear according to claim 4, wherein the group of connecting portions allow the first group and the second group to rotate with respect to an adjoining member in a first rotational direction or a second rotational direction thereby defining a second configuration.

6. The article of footwear according to claim 5, wherein the second connecting portion and the fifth connecting portion are spaced apart a third distance from each other in the second configuration;

wherein the eighth connecting portion and the ninth connecting portion are spaced apart a fourth distance from each other in the second configuration;

wherein the first distance is less than the third distance; and wherein the fourth distance is less than the second distance.

7. The article of footwear according to claim 6, the third interior aperture is larger than the first interior aperture, and wherein the third interior aperture is larger than the second interior aperture.

8. The article of footwear according to claim 1, wherein the members are hingedly connected to one another at the connecting portions thereby allowing the members to rotate with respect to each other in a plane of the sole structure.

9. The article of footwear according to claim 7, wherein the first interior aperture expands on a top sole surface and a bottom sole surface when the first exterior member, the first interior member, the third exterior member, and the third interior member are rotated.

10. The article of footwear according to claim 1, where a thickness of the sole structure is greater than one-half a size of a smaller edge of the first exterior member.

11. The article of footwear according to claim 1, wherein a thickness of the sole structure is at least 5.0 mm.

12. The article of footwear according to claim 1, wherein a thickness of the sole structure is greater than a first separation distance between the second connecting portion and the fifth connecting portion.

13. The article of footwear according to claim 1, wherein the third area of the third interior aperture decreases when a vertical force is applied to the sole structure.

14. The article of footwear according to claim 13, wherein a length of the first exterior member increases when the vertical force is applied to the sole structure.

15. The article of footwear according to claim 1, wherein the sole structure has a thickness extending from a top surface of the group of members to a bottom surface of the group of members; and wherein the thickness of the sole structure varies throughout the sole structure to provide different degrees of flexibility to areas of the sole structure.

16. The article of footwear according to claim 1, wherein the third interior aperture is longer than both of the first interior aperture and the second interior aperture.

* * * * *